United States Patent [19]

Imaizumi

[11] Patent Number: 4,855,168

[45] Date of Patent: Aug. 8, 1989

[54] SYNTHETIC RESIN SHEET HAVING NOTCHING STRIP AND CONTAINER

[75] Inventor: Yasuyuki Imaizumi, Tokyo, Japan

[73] Assignee: Yoshino Kogyosho Co., Ltd., Tokyo, Japan

[21] Appl. No.: 35,310

[22] Filed: Apr. 7, 1987

[51] Int. Cl.[4] ..... B65D 77/30; B65D 25/28

[52] U.S. Cl. ..... 428/35.2; 428/476.1; 428/516; 428/520; 428/35.4; 428/35.7; 428/36.6; 264/176.1; 206/161; 206/203; 220/430; 220/96

[58] Field of Search ..... 428/35, 476.1, 516, 428/520

[56] References Cited

U.S. PATENT DOCUMENTS 4,533,576 8/1985 Tanahashi et al. ..... 428/35
4,613,531 9/1986 Gokcen et al. ..... 428/35

FOREIGN PATENT DOCUMENTS 0210725 2/1987 European Pat. Off. ..... 428/35

*Primary Examiner*—P. C. Ives
*Attorney, Agent, or Firm*—Oliff & Berridge

[57] ABSTRACT

A synthetic resin sheet integrally coextruded by coextruding sheet main body portions and a slender notching strip interposed between right and left side sheet main body portions, wherein the notching strip is formed of a mixture resin material of a first synthetic resin material of molding material of the sheet main body portions, a second synthetic resin material impossible to be bonded with the first synthetic resin material, a third synthetic resin material possible to be bonded with the first and second synthetic resin materials, and a fourth synthetic resin material for softening the molded notching strip, melt index value of the notching strip is the same as or substantially lower than that of the main body portions, and the softening temperature of the notching strip is the same as or substantially higher than that of the sheet main body portions, and a thermally molded container formed of the sheet, thereby smoothly and clearly separating the sheet main body portions and the notching strip of the sheet.

6 Claims, 3 Drawing Sheets

SYNTHETIC RESIN SHEET HAVING NOTCHING STRIP AND CONTAINER

BACKGROUND OF THE INVENTION

The present invention relates to a synthetic resin sheet having a notching strip and a sheet container formed of the synthetic resin sheet and, more particularly, to a synthetic resin sheet which can be smoothly and clearly divided by the notching strip and the container formed of the sheet.

There is a synthetic resin sheet formed by integrally molding by coextruding means a sheet body and a notching strip in the state that the sheet body is divided by the notching strip into right and left side sheet body portions and the notching strip is interposed between the right and left side sheet body portions, and a container such as a bag or a tubular container is formed of the sheet.

The conventional synthetic resin sheet with a notching strip of this type is necessary to be held in the state that the bonding strengths between the sheet body portions and the notching strip are sufficiently high so that the mechanical strength of the entire sheet is sufficiently high until the sheet main body portions are separated through the notching strip, and is also required to have convergent function of disabling to increase the bonding strength between the sheet body portions and the notching strip so that the separating operation of the sheet body portions of the sheet may be smoothly and reliably achieved through the notching strip.

Thus, the synthetic resin sheet with the notching strip of this type has been relatively increased in the bonding strength between the sheet main body portions and the notching strip to satisfy the abovementioned contradictory required matters, has been increased in the hardness of the notching strip itself higher than those of the sheet body portions to thereby enhance the mechanical strength of the entire sheet, and has been separated between the sheet body portions by damaging the bondings between the sheet body portions and the notching strip by special means such as bending.

However, a considerably large force is necessary to separate the bonding between the sheet body portions and the notching strip in the above-described conventional sheet. Thus, the separating operation of the entire sheet is extremely difficult to perform. Further, a number of unnecessary synthetic resin pieces of yarn shape have been formed at the end faces of the separate sheet body portions from the notching strip to causing an unpleasant feel to its user.

The hardness of the notching strip has been raised to sufficiently enhance its mechanical strength, but since the strip has thus become mechanically brittle, the strip has readily been broken when the entire sheet is separate by pulling the strip, and a drawback might occur in that the overall sheet cannot be separated into the respective sheet body portions and the strip.

When a sheet container is, further, formed by a thermal molding method such as vacuum molding or pneumatic molding with the synthetic resin sheet with the notching strip, the bonding strengths between the sheet body portions and the notching strip are largely increased by the thermal action on the sheet at the thermal molding time, thereby disabling to manually separate between the sheet body portions and the notching strip of the sheet. Therefore, the thermally molded container of the synthetic resin sheet with the notching strip could not be heretofore formed.

SUMMARY OF THE INVENTION

Accordingly, an object of the present invention is to provide a synthetic resin sheet having a notching strip and a sheet container made of the sheet which can be smoothly and clearly separated between sheet main body portions and the notching strip.

In order to achieve the above and other objects, there are provided according to the present invention a synthetic resin sheet integrally coextruded by coextruding sheet main body portions and a slender notching strip interposed between right and left side sheet main body portions, wherein the notching strip is formed of a mixture resin material of a first synthetic resin material of molding material of the sheet main body portions, a second synthetic resin material impossible to be bonded with the first synthetic resin material, a third synthetic resin material possible to be bonded with the first and second synthetic resin materials, and a fourth synthetic resin material for softening the molded notching strip, melt index value of the notching strip is the same as or substantially lower than that of the main body portions, and the softening temperature of the notching strip is the same as or substantially higher than that of the sheet main body portions, and a thermally molded container formed from the sheet, thereby smoothly and clearly separating the sheet main body portions and the notching strip of the sheet.

These and other objects and features will become more apparent from the following description of the preferred embodiments of the present invention when read in connection with the accompanying drawings.

DESCRIPTION OF THE PREFERRED EMBODIMENTS

Figure 1:
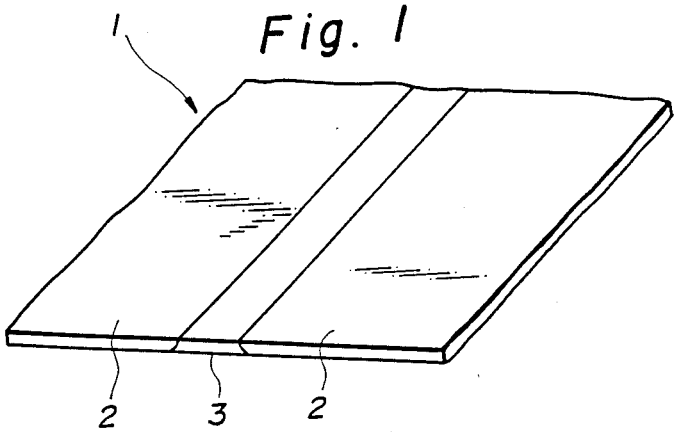
FIG. 1 is an enlarged perspective view of the essential portion of an embodiment of a synthetic resin sheet having a notching strip according to the present invention.

Embodiments of a synthetic resin sheet according to the present invention will now be described in detail with reference to the accompanying drawings.

A synthetic resin sheet 1 provided comprises sheet main body portions 2 and a notching strip 3 interposed between the right and left side sheet main body portions 2 and are of slender shape. The notching strip 3 is formed of a mixture resin material of a first synthetic resin material of molding material of the sheet main body portions 2, a second synthetic resin material impossible to be bonded with the first synthetic resin material, a third synthetic resin material possible to be bonded with the first and second synthetic resin materials, and a fourth synthetic resin material for softening the molded notching strip. The melt index value T of the notching strip 3 is the same as or substantially lower than that of the sheet main body portions 2 and the softening temperature T' of the notching strip 3 is the same as or substantially higher than that M' of the sheet main body portions 2.

A container 11 or 24 formed of the synthetic resin sheet 1 is molded in container body 16, 25 of predetermined shape by thermal molding means such as vacuum molding or pneumatic molding the synthetic resin sheet 1 which comprises sheet main body portions 12, 22 and a notching strip 13, 23 of slender shape interposed between the sheet main body portions 12, 22 for dividing the sheet main body into right and left side sheet body portions 12, 22, and is molded by integrally coextruding the sheet main body portions and the notching strip. The notching strip 13, 23 is formed of a mixture resin material of a first synthetic resin material of molding material of the sheet main body portions 12, 22, a second synthetic resin material impossible to be bonded with the first synthetic resin material, a third synthetic resin material possible to be bonded with the first and second synthetic resin materials, and a fourth synthetic resin material for softening the molded notching strip 13, 23 and the melt index value T of the notching strip 13, 23 is the same as or substantially lower than that of the sheet main body portions and the softening temperature T' of the notching strip 13, 23 is the same as or substantially higher than that M' of the sheet main body portions 12, 23.

Figure 2:
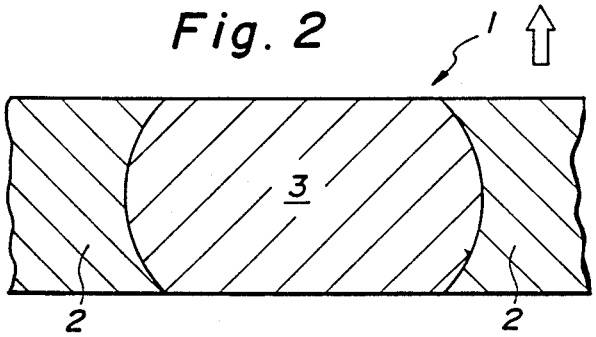
FIGS. 2 and 3 are partial sectional views of the sheet extrusion molded according to the invention.
Figure 3:
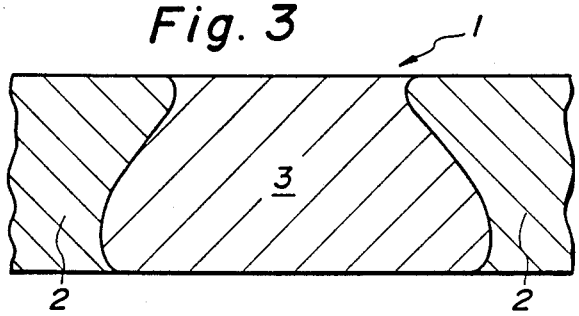

More specifically, in FIGS. 1, 2 and 3, the notching strip 3 is formed mainly of the first synthetic resin material of the molding material of the sheet main body portions 2, and by adding and mixing with the synthetic resin material the second synthetic resin material impossible to be bonded with the first synthetic resin material, and the third synthetic resin material possible to be bonded with the first and second synthetic resin materials. Thus, the sheet 1 of the present invention can set the bonding strength of the notching strip 3 to the sheet main body portions 2 to a desired predetermined value by utilizing the contradictory characteristics of the second and third synthetic resin materials. In this manner, the bonding force between the sheet main body portions 2 and the notching strip 3 of the sheet 1 according to the invention is set by the characteristics of the synthetic resin materials for molding the sheet main body portions 2 and the notching strip 3. Therefore, even if the sheet 1 is externally heat treated, the bonding strength between the sheet main body portions 2 and the notching strip 3 is not varied at all.

Figure 4:
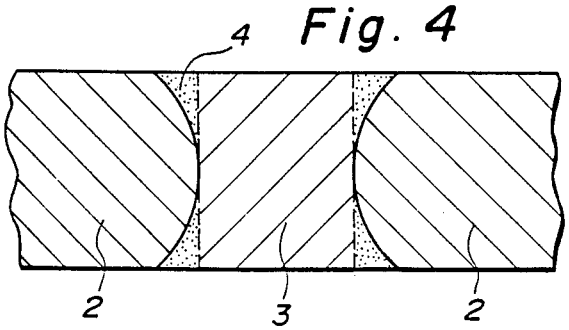
FIG. 4 is a partial sectional view of the sheet of a comparison example.

Further, the melt index value T of the notching strip 3 is set to a value equal to or substantially lower than the melt index value M of the sheet main body portions 2. Thus, the section of the extruded sheet 1 is, as shown in FIG. 2, formed so that the center of the notching strip 3 is swelled laterally to the right and left side sheet main body portions 2. When the sheet 1 thus extruded is further molded by a cooling roller and is charged in a mold, the section of the sheet 1 is, as shown in FIG. 3, formed so that the section of the notching strip 3 becomes a substantially trapezoidal shape. Thus, when the sheet main body portion 2 is pulled in a perpendicular direction to the sheet plane in FIG. 2, the sheet main body portions 2 and the notching strip 3 can be smoothly separated without any engagement. On the contrary, when the melt index value T of the notching strip 3 is set to a value higher than the melt index value M of the sheet main body portions 2, the section of the sheet 1 is, as shown in FIG. 4, formed so that the sheet main body portions 2 are intruded into the centers of the both sides of the notching strip 3. When the sheet main body portions 2 and the notching strip 3 of the sheet 1 thus formed are separated, the sheet main body portions 2 and the notching strip 3 tend to be separated at the portions 4 designated by the shaded portion indicated by parallel oblique broken lines in FIG. 4. Thus, it is disadvantageous that shaded portions 4 in FIG. 4 become synthetic resin pieces of a thread or yarn state. Since the melt index value T of the notching strip 3 is set to the value equal to or substantially lower than the melt index value M of the sheet main body portions 2 in the sheet 1 of the present invention, a difficulty can be eliminated that the sheet 1 cannot be preferably bent due to the notching strip 3 when handling the molded sheet 1, thereby handling the sheet 1 substantially in the same manner as the ordinary synthetic resin sheet.

Further, the softening temperature T' of the notching strip 3 is set to a value equal to or substantially higher than the softening temperature M' of the sheet main body portions 2. Thus, even if the sheet 1 is heated externally due to certain molding, the notching strip 3 is bent or deformed along the longitudinal direction, but is not collapsed in the slender shape.

The sheet 1 of the invention is integrally extruded by coextruding the sheet main body portions 2 and the notching strip 3. When the sheet main body portions 2 are, for example, molded of polypropylene resin, it is considered that the first synthetic resin material for molding the notching strip 3 is formed of polypropylene resin, the second synthetic resin material is formed of synthetic resin material impossible to be bonded with the polypropylene resin such as, for example, nylon, or ethylene-vinyl alcohol copolymer resin, the third synthetic resin material is formed of a bondable polymer possible to be bonded with the second synthetic resin and the polypropylene, and the fourth synthetic resin material is formed of a resin in which molecules of ethylene-methacrylic acid copolymer are crosslinked by metallic ions in combination.

The mixture ratio by weight of the above-mentioned synthetic resin materials for molding the notching strip 3 depends upon the bonding strength between the required sheet main body portions 2 and the notching strip 3, the object of use and using conditions of the molded sheet 1 or container 4. According to the results of a number of experiments, 30 to 50% of polypropylene of the first synthetic resin material, 3 to 20% of the material impossible to be bonded of the second synthetic resin material, 30 to 50% of bondable polymer of the third synthetic resin material and 5 to 20% of ethylene-methacrylic acid copolymer of the fourth synthetic resin material are preferably mixed.

Figure 5:
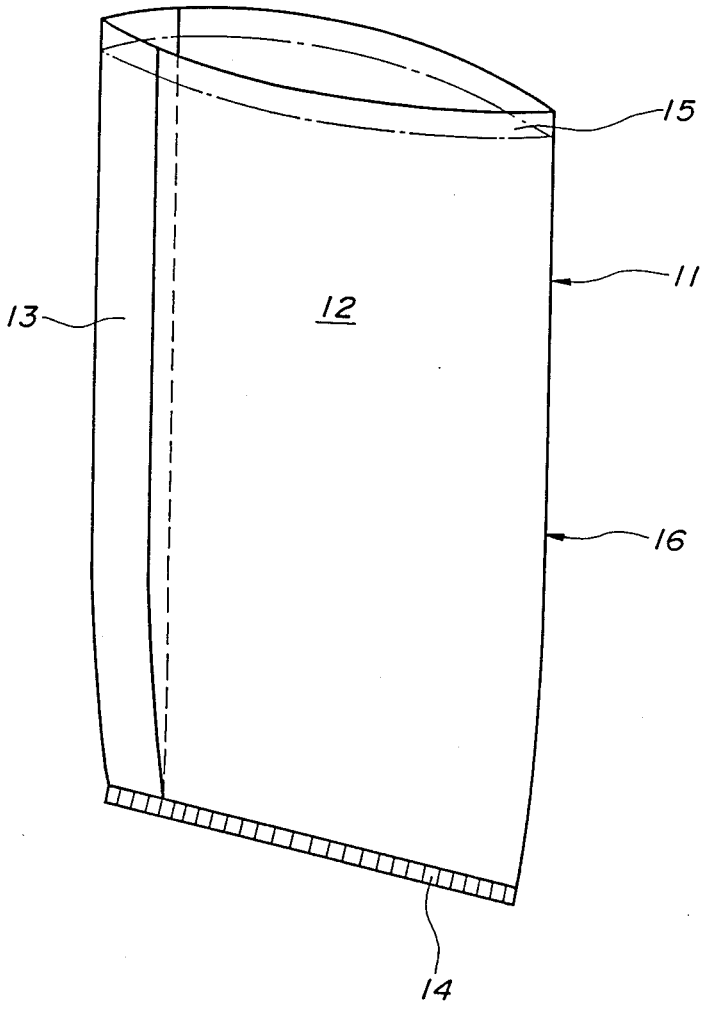
FIG. 5 is a perspective view of an embodiment of a container according to the present invention.
Figure 6:
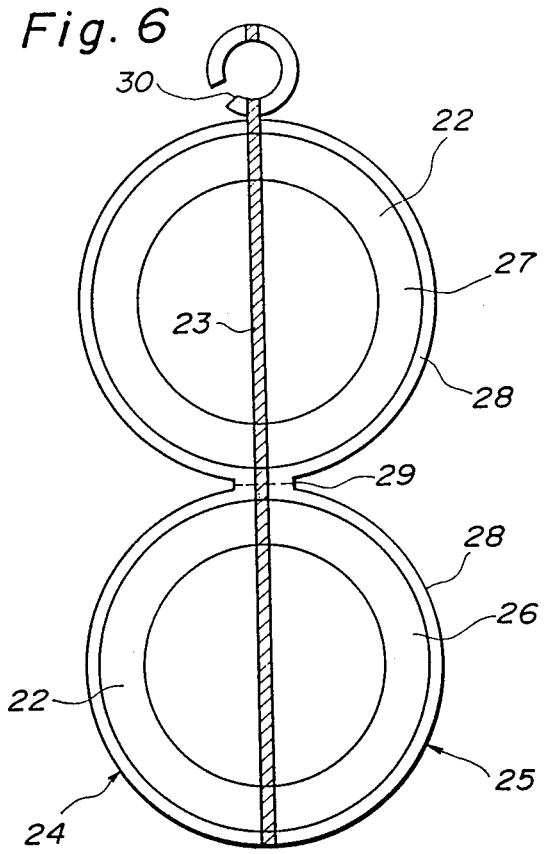
FIG. 6 is a view of developed state of a second embodiment of a container of the invention.
Figure 7:
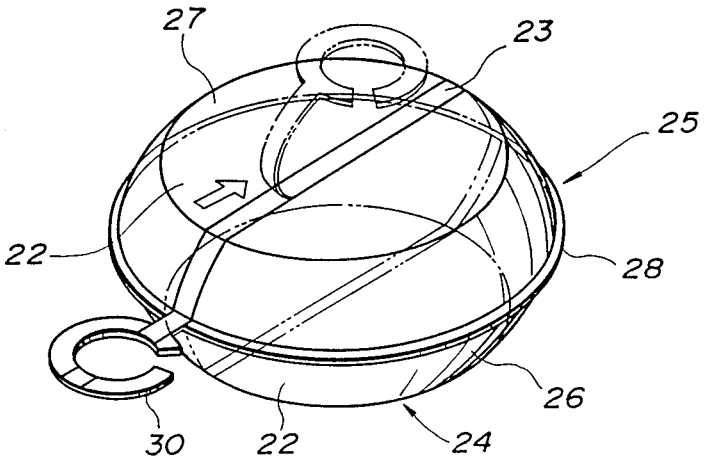
FIG. 7 is a perspective view of the entirely assembled container of FIG. 6.

A container shown in FIGS. 5 to 7 is molded by a thermal molding method with the sheet formed according to the present invention in FIG. 1. FIG. 5 shows an embodiment of the container of the invention.

In FIG. 5, a container 11 is formed in a tubular shape of a sheet main body portion 12 and a notching strip 13, and is sealed at one end or bottom 14 thereof. The container 11 is molded in the tubular shape by coextruding the sheet main body portion 12 and the notching strip 13, and then sealing the one end 14 to close it. A content to be filled is filled in the container 11, and the other end or top 15 is bonded fixedly by any means to hermetically seal the content in the container 11.

To discharge the content from the container 11 for hermetically sealing and containing the content, the end 14 or 15 of the main body portion 12 near the notching strip 13 and the end of the notching strip 13 are grasped by fingers, and the notching strip 13 is collapsed along the longitudinal axial direction of the container 11.

The section of the sheet of the container 11 is swelled at the centers of both the sides of the notching strip 3 to the sheet main body portions as shown in FIG. 2 so as not to pass the cooling roller. Thus, when the sheet main body portions 12 and the notching strip 13 are separated, unnecessary synthetic resin pieces of a yarn state are not formed.

A container 24 shown in FIGS. 6 and 7 is another embodiment molded by a thermally molding method with the sheet 1 of the invention in FIG. 1. The container 24 is formed by coupling a semispherical vessel 26 with a cover 27 by a hinge 29, forming bonding flanges at the outer peripheral edges of the vessel 26 and the cover 27, and disposing a notching strip 23 in the state of traversing the vessel 26 and the cover 27 through the hinge 29 to form a container body 25. In this embodiment, the end of the notching strip 23 disposed at the peripheral end opposite to the hinge 29 is extended as it is to form a gripping piece 30.

The gripping piece 30 is formed in a hook shape to be conveniently handled for the container 24 and to be readly grasped by fingers.

The container 24 is molded in a desired predetermined shape by a thermal molding method with the flat sheet 1, and cut from the sheet 1 as shown in FIG. 5 to complete the molding.

The container 24 thus molded is bent at the hinge 29 as shown in FIG. 7 in the state that a content to be filled is contained therein, and bonded fixedly at both the flanges 28 by suitable means to completely seal and contain the content therein.

The container 24 for sealing and containing the content is opened, as shown in FIG. 7, by pulling up the gripping piece 30 to separate between the sheet main body portion 22 and the notching strip 23. In this case, since the notching strip 23 is wound on the entire periphery of the container 24 of sealed state, the container 24 is split at the center and opened by completely separating and removing the notching strip 23.

When the container 23 is molded by the thermal molding method of the sheet 1, the sheet main body portions 22 and the notching strip 23 of the sheet 1 are softened by the heat of the thermal molding method to be molded in the desired shape, but since the softening temperature T' of the notching strip 23 is equal to or substantially higher than the softening temperature M' of the sheet main body portions 22, the notching strip 23 is not so substantially deformed as to be the sheet main body portions 22, but is molded as part of the container 24.

However, since the bonding strengths of the bonded portions of the sheet main body portions 22 and the notching strip 23 are, naturally, much weaker than the tensile strength of the sole sheet main body portion 22, it is necessary not to apply the tensile force laterally of the notching strip 23 to the notching strip 23 by considering the method of molding, and the structure of the molded container 24 as well as the position of the notching strip 23 in the container 24 molded in the container 24 molded when the container 24 is molded by the thermal molding method from the sheet 1.

For example, in the case of the embodiment in FIGS. 6 and 7, the notching strip 23 is disposed in the state of traversing the center of the container 24. Thus, the tensile force is acted along the longitudinal direction on the notching strip 23 at the thermal molding time, but is not substantially acted in the lateral direction.

As described above, the synthetic resin sheet formed according to the present invention can freely set the bonding strength between the sheet main body portions and the notching strip. Therefore, the bonding strength between the sheet main body portions and the notching strip can be set to an optimum value in response to the object to be used of the sheet and the using conditions of the sheet. Since the melt index value of the notching strip is set to the value equal to or substantially lower than that of the sheet main body portion and the material impossible to be bonded to the synthetic resin material for molding the sheet main body portions is mixed in the molding material of the notching strip, the separating ends of the sheet main body portions can be clearly made. Since the bonding strength between the sheet main body portions and the notching strip is determined according to the physical properties of the molding materials, even if the container is molded by thermal molding the sheet, a difficulty that the bonding strength between the sheet main body portions and the notching strip is excessively strengthened does not occur. Since the notching strip is more difficult to deform than the sheet main body portion when the container is molded by thermal molding the sheet, the thickness of the notching strip tends to be slightly increased as compared with the sheet main body portions, thereby smoothly and preferably separating the sheet main body portions by the notching strip.

The sheet molded of the synthetic resin sheet of the present invention is used to remove foodstuff or sanitary product or content after separating the sheet main body portions and the notching strip. Therefore, the sealed sheet can exhibit no opening at all and can be important in public sanitation.

What is claimed is:

1. A synthetic resin sheet integrally coextruded by coextruding sheet main body portions of polyolefin resin and a notching strip interposed between right and left side sheet main body portions, wherein:

the notching strip is formed of a mixture resin material of a first synthetic resin material of polyolefin resin, a second synthetic resin material incapable of bonding with the first synthetic resin material, a third synthetic resin material capable of bonding with the first and second synthetic resin materials, and a fourth synthetic resin material of a copolymer of olefin and vinyl monomer having carboxylic radicals crosslinked by metallic ions;

the melt index value of the notching strip being no greater than that of the sheet main body portions; and the softening temperature of the notching strip being no lower than that of the sheet main body portions.

2. The synthetic resin sheet according to claim 1, wherein said sheet main body portions are formed of polypropylene resin, the first synthetic resin material for molding the notching strip is formed of polypropylene resin, the second synthetic resin material is formed of synthetic resin material incapable of bonding with the polypropylene resin, the third synthetic resin material is formed of a bondable polymer capable of bonding with the second synthetic resin and the polypropylene, and the fourth synthetic resin material is formed of a resin in which molecules of ethylene-methacrylic acid copolymer are crosslinked by metallic ions.

3. The synthetic resin sheet according to claim 2, wherein said notching strip comprises 30 to 50 wt. % of polypropylene, 3 to 20 wt. % of the material incapable of bonding with the polypropylene, 30 to 50 wt. % of ethylene-methacrylic acid copolymer.

4. A container formed of a synthetic resin sheet integrally coextruded by coextruding sheet main body portions and a shaped notching strip interposed between right and left side sheet main body portions, wherein said notching strip is formed of a mixture resin material of a first synthetic resin material of molding material of the sheet main body portions, a second synthetic resin material incapable of bonding with the first synthetic material, a third synthetic resin material capable of bonding with the first and second synthetic resin materials, and a fourth synthetic resin material for softening the molded notching strip, melt index value of said notching strip being no greater than that of the sheet main body portions, and the softening temperature of the notching strip being no lower than that of the sheet main body portions.

5. The container according to claim 4, wherein an end of said notching strip is protruded with a gripping piece.

6. A synthetic resin sheet integrally coextruded by coextruding sheet main body portions of polypropylene and a notching strip interposed between right and left side sheet main body portions, wherein:

the notching strip is formed of a mixture resin material of a first synthetic resin material of polypropylene, a second synthetic resin material of nylon or ethylene-vinyl alcohol copolymer resin, a third synthetic resin material capable of bonding with the first and second synthetic resin materials, and a fourth synthetic resin material of ethylene-methacrylic acid copolymer crosslinked by metallic ions;

melt index value of the notching strip being no greater than that of the sheet main body portions; and the softening temperature of the notching strip being no lower than that of the sheet main body portions.

* * * * *